US008475072B1

(12) United States Patent
Buckner et al.

(10) Patent No.: US 8,475,072 B1
(45) Date of Patent: Jul. 2, 2013

(54) SCRAPING APPARATUS FOR INTEGRATION WITH PRESSURE WASHING WAND

(76) Inventors: Kenneth Buckner, Lake Worth, FL (US); Jason Boyle, Delray Beach, FL (US)

( * ) Notice: Subject to any disclaimer, the term of this patent is extended or adjusted under 35 U.S.C. 154(b) by 1479 days.

(21) Appl. No.: 11/961,279

(22) Filed: Dec. 20, 2007

(51) Int. Cl.
*A47L 13/30* (2006.01)

(52) U.S. Cl.
USPC ..... 401/261; 401/25

(58) Field of Classification Search
USPC ..... 401/261, 265, 266, 25; 15/256.5
See application file for complete search history.

(56) References Cited

U.S. PATENT DOCUMENTS 2,298,765 A 10/1942 Johnson
2,982,987 A * 5/1961 Knapp ..... 401/139
3,143,984 A 8/1964 Morasch
5,054,159 A * 10/1991 Richardson ..... 15/400
5,072,486 A 12/1991 Guarascio
5,116,152 A 5/1992 Caswell
5,477,583 A 12/1995 Deloe
5,685,251 A 11/1997 Halko
5,774,993 A * 7/1998 Schlessmann ..... 30/276
5,865,555 A * 2/1999 Dawson ..... 401/266
6,120,205 A * 9/2000 Larson ..... 401/261
7,927,033 B2 * 4/2011 Gansebom et al. ..... 401/139

* cited by examiner

*Primary Examiner* — David Walczak
(74) *Attorney, Agent, or Firm* — Gold & Rizvi, P.A.; Glenn E. Gold

(57) ABSTRACT

A scraping apparatus (350), which secures to a wand (142) of a pressure sprayer. The scraping apparatus (350) includes a scraping blade (120), which is fastened to a spacing block (352). The assembly is secured to the wand (142) via a clamping mechanism (354). The clamping mechanism (354) can be of a quick release design. The rotating blade (152) can be pivotally assembled to the block (352) and held in position by any of a variety of designs.

14 Claims, 22 Drawing Sheets

SCRAPING APPARATUS FOR INTEGRATION WITH PRESSURE WASHING WAND

BACKGROUND OF THE INVENTION

1. Field of the Invention

The present invention relates generally to scraping devices. More particularly, the present application involves a scraping device for use with a pressure washing wand.

2. Discussion of the Related Art

Deloe (U.S. Pat. No. 5,477,583) discloses a device for cleaning mowing machinery, which is adapted for connection to the end of a hose to receive a pressurized supply of water. The device includes a tube, a channel passage for the pressurized water, a connector for connecting one end of the tube to the hose, and a scraper element disposed at the other end of the tube. The scraper element has a base section, a hose-like neck section, and a water outlet positioned over the base section. The scraper incorporates an angle between the wand pipe extension, the wand, and the scraper. Deloe is limited in that Deloe requires the wand to be incorporated into the scraper section of the device in order to accommodate the angle. Additionally, the scraping design is specific to the pressure wand.

Caswell (U.S. Pat. No. 5,116,152) discloses an apparatus wherein a fluid nozzle is arranged with a valve figure to affect fluid flow through the nozzle, wherein the nozzle includes a scraper blade mounted within the housing to permit reciprocation of the scraper blade from a first position to a second position extended forwardly of the wand to permit simultaneous scraping and cleaning. Caswell is limited in that the scraper is fastened to the housing in a manner to be reciprocating. Caswell's design requires a custom housing for the wand to accommodate the scraper, wherein the design is not conducive to an aftermarket product.

Halko (U.S. Pat. No. 5,685,251) discloses a water jet powered boat bottom cleaning system which removes barnacles and other accumulated debris from a boat bottom by applying an upward force from a buoyant boule-shaped member coupled with the force exerted by a plurality of water jets to an interchangeable scraper blade during reciprocating movement caused by the user. Halko orients the scraper perpendicular to the handle portion. Halko is limited in the design to accommodate the various forces. The water jets are designed to discharge away from the end of the interchangeable scraper blade (col 4, Lines 41-42).

The high pressure cleaning process projects a fluid (generally water) with a significant force towards an object and, as with all physics, an equal and opposite force of the handle in an equal and opposite direction.

There are many high pressure cleaning devices available. What is lacking is a scraping device that can be secured to the currently available high pressure cleaning devices without requiring modifications to the high pressure cleaning devices, yet sturdy enough to withstand the forces exerted for scraping.

Ideally, a scraping device that can be coupled to a standard pressure cleaning device is desired.

SUMMARY OF THE INVENTION

The present invention is directed to a scraping apparatus designed to be secured to a wand section of a commonly available pressure cleaning wand.

A first aspect of the present invention is a scraper including a scraping blade, a spacer block, and a wand coupling mechanism.

Yet another aspect of the present invention incorporates a friction-increasing feature on a wand contacting side section of the wand coupling mechanism.

Yet another aspect incorporates a quick release design for the wand coupling mechanism.

Yet another aspect incorporates a wand coupling mechanism comprising a pair of threaded members, one member having standard threading, the second having reverse threading.

Yet another aspect incorporates a wand coupling mechanism comprising a hinged clamping bracket, the clamping bracket being hinged on a first side and having a latching fastener on the second side. One such latching fastener can be a threaded design.

Yet another aspect incorporates a wand coupling mechanism comprising a "V" shaped wand-receiving section.

Yet another aspect incorporates a scraping blade having a first scraping edge and an opposing scraping edge.

Yet another aspect incorporates a scraping blade having a first scraping edge with a first scraping width and an opposing scraping edge having a second scraping width, wherein the first scraping width differs from the second scraping width.

Yet another aspect provides a reversible blade, wherein the reversible blade pivots about a central pivot point.

Yet another aspect provides a reversible blade, wherein the reversible blade is locked into usable configuration.

Yet another aspect locks the reversible blade via a threaded fastener.

Yet another aspect locks the reversible blade via at least one rotating blade securing latch.

Yet another aspect locks the reversible blade via a hook and latch mechanism.

Yet another aspect utilizes all non-corrosive materials in the construction of the present invention.

These and other features, aspects, and advantages of the invention will be further understood and appreciated by those skilled in the art by reference to the following written specification, claims, and appended drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the various views of the drawings.

DETAILED DESCRIPTION OF THE PREFERRED EMBODIMENT

Figure 1:
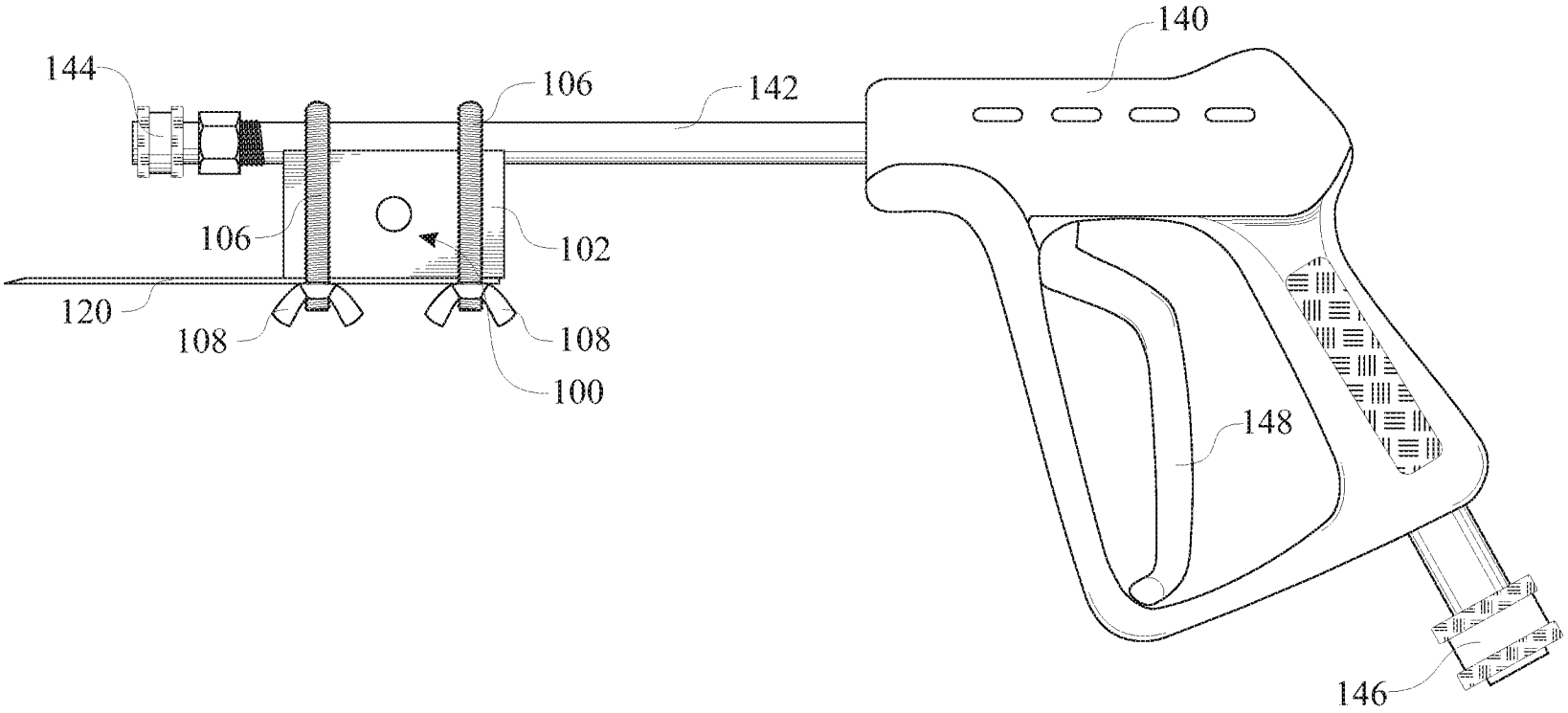
FIG. 1 is an elevation, side view of a prototype pressure cleaner scraper assembled to a pressure cleaner wand.
Figure 2:
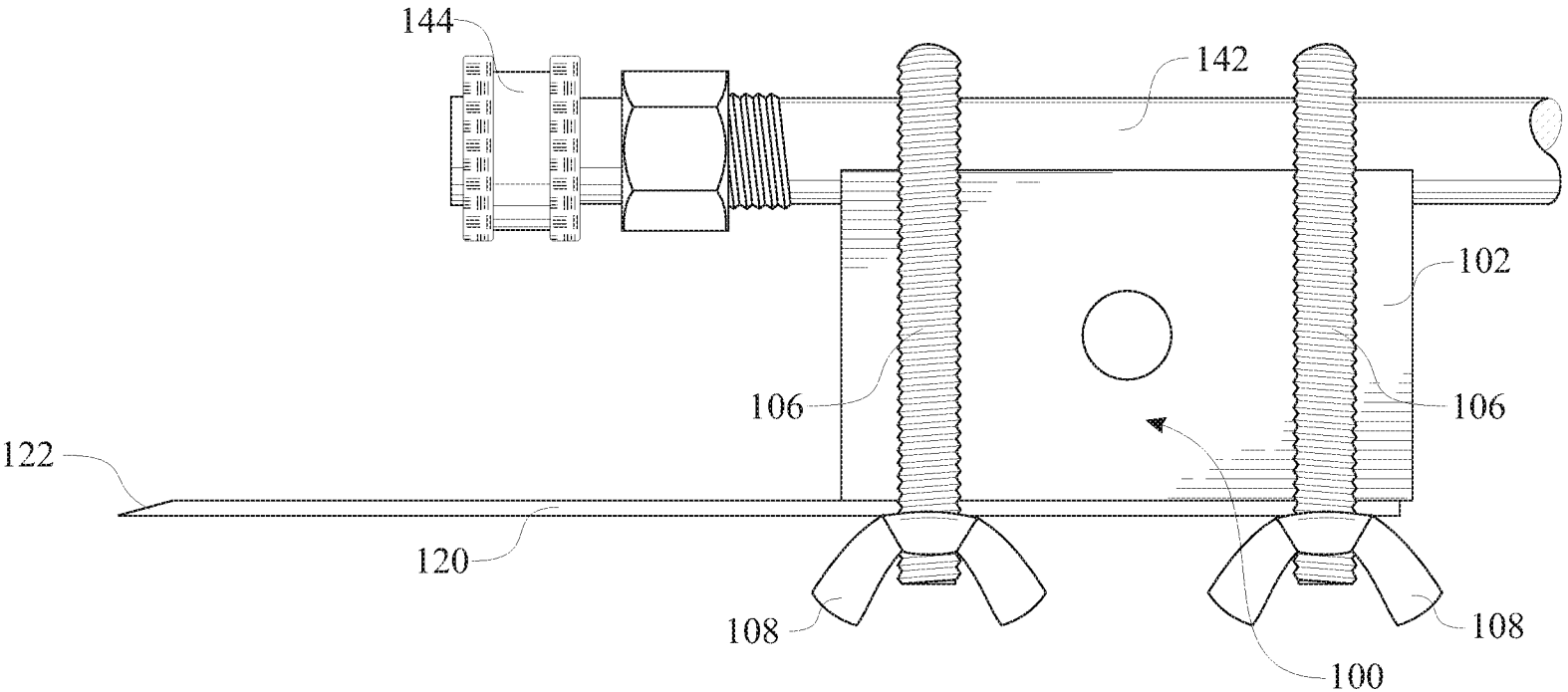
FIG. 2 is a magnified view of the prototype pressure cleaner scraper as presented in FIG. 1.
Figure 4:
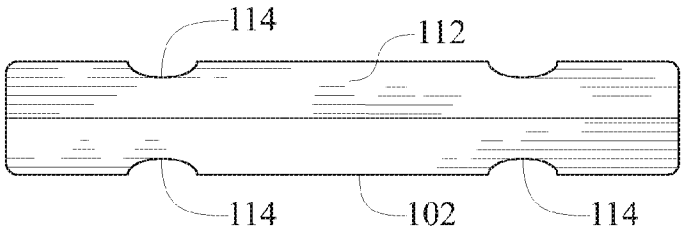
FIG. 4 is a top view of a spacer block of FIG. 3 utilized in the prototype pressure cleaner scraper.
Figure 6:
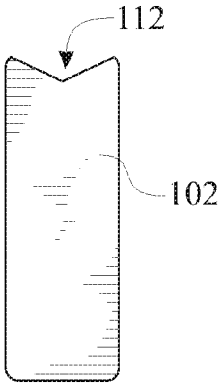
FIG. 6 is an end view of a spacer block of FIG. 3 utilized in the prototype pressure cleaner scraper.
Figure 3:
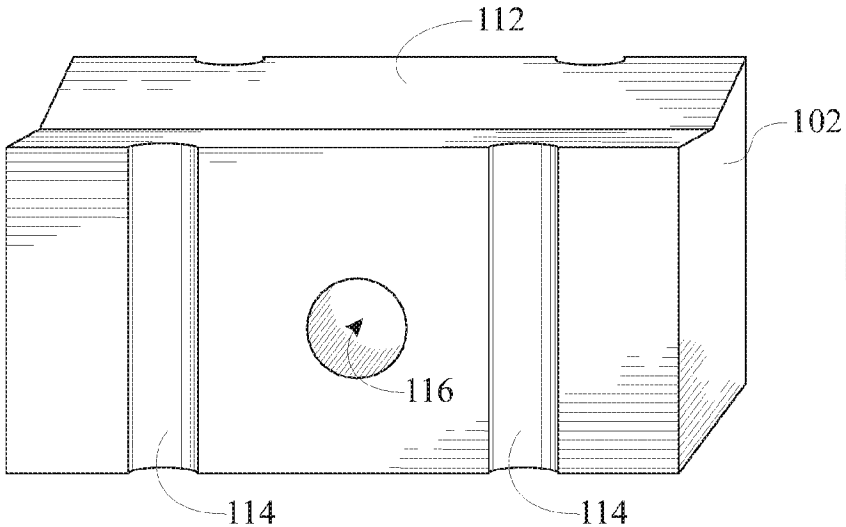
FIG. 3 is a perspective view of a spacer block utilized in the prototype pressure cleaner scraper.
Figure 5:
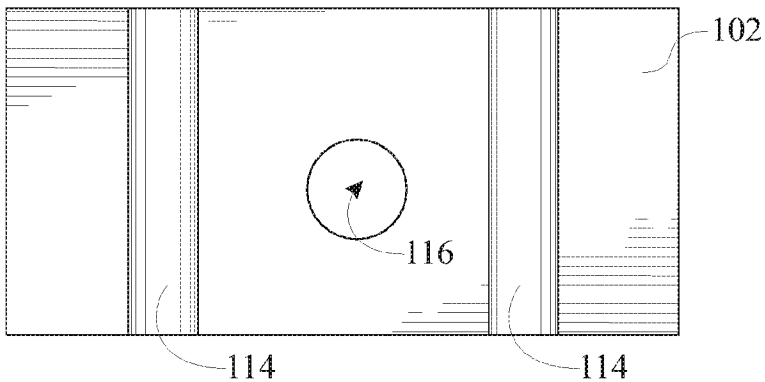
FIG. 5 is a side view of a spacer block of FIG. 3 utilized in the prototype pressure cleaner scraper.
Figure 7:
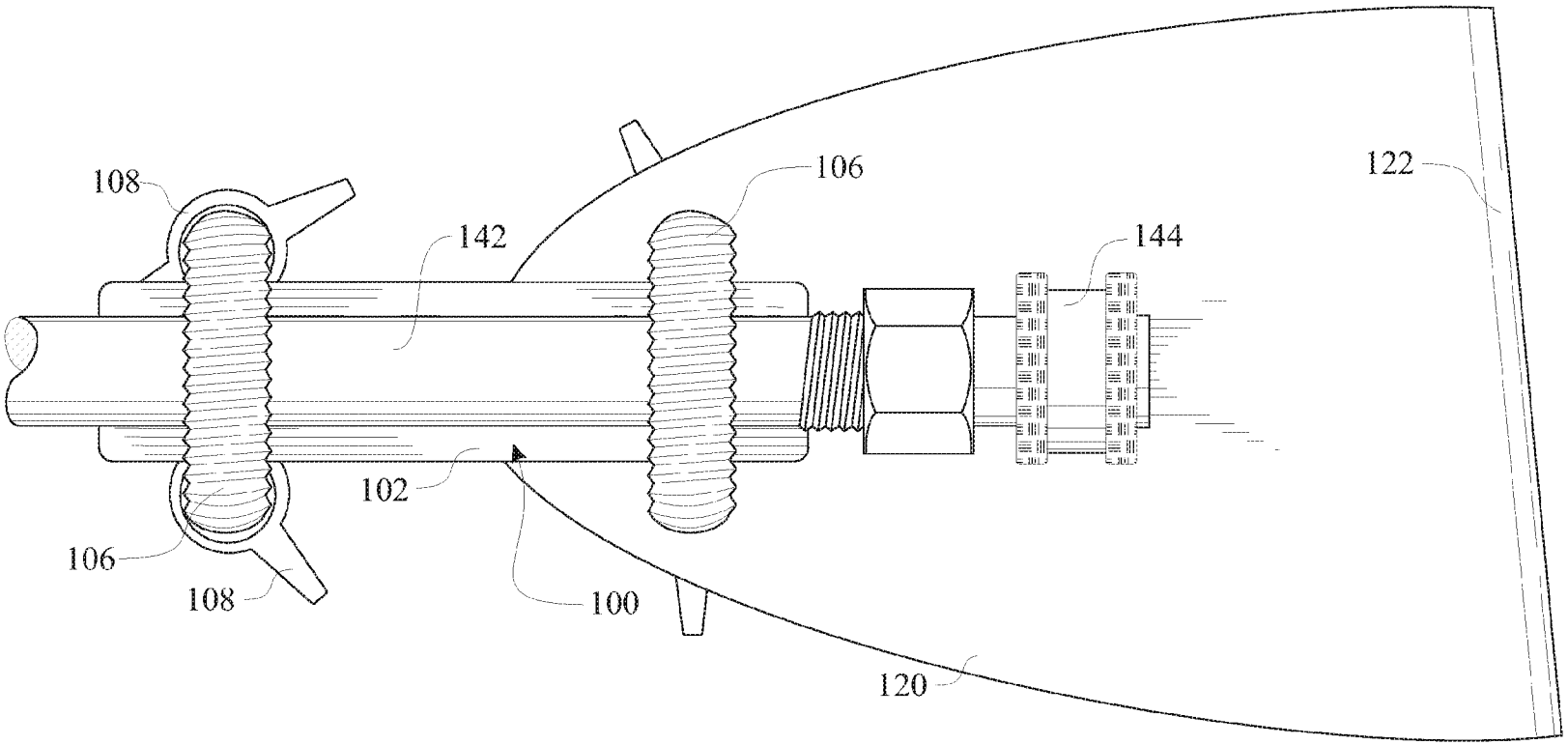
FIG. 7 is a magnified top view of the prototype pressure cleaner scraper as presented in FIG. 1.
Figure 8:
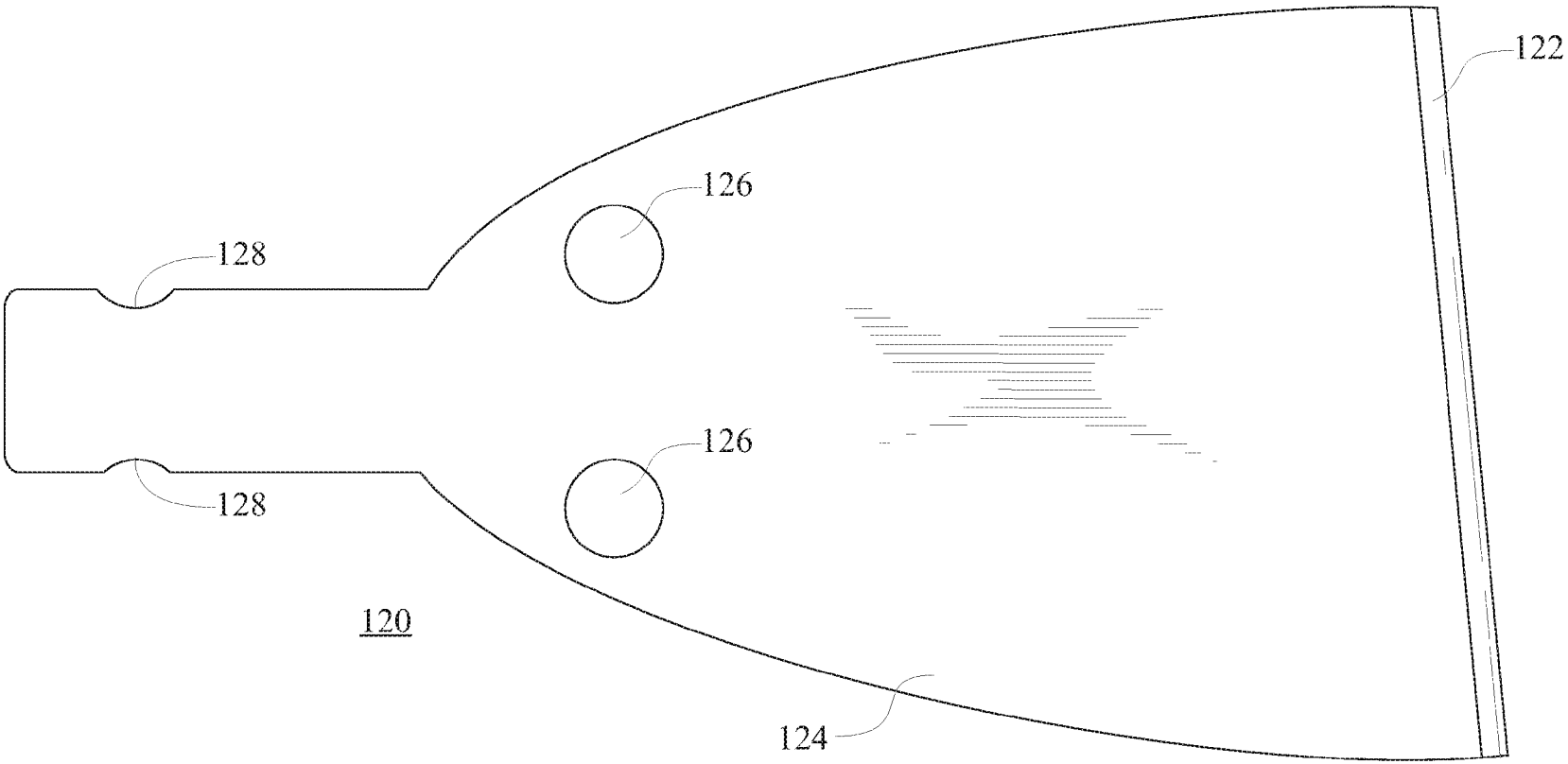
FIG. 8 is a top view of a single-edge scraping blade utilized in the prototype pressure cleaner scraper of FIG. 1.

For purposes of description herein, the terms "upper", "lower", "left", "rear", "right", "front", "vertical", "horizontal", and derivatives thereof shall relate to the invention as oriented in FIG. 1. However, one will understand that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Turning to the drawings, FIGS. 1 through 8 present a various views of a prototype pressure cleaning wand and scraping apparatus 100. The prototype pressure wand and scraping apparatus 100 is designed to be securely fastened to a pressure sprayer extension pipe 142 of any commonly sold pressure sprayer assembly. The pressure sprayer assembly comprises a pressure sprayer handle 140, the pressure sprayer handle 140 having a pressure source coupler 146 for fluidly coupling to a fluid pressure source, a spray trigger 148 for controlling the flow of the pressurized water, and a spray nozzle 144 fluidly coupled to the pressure sprayer handle 140 via the pressure sprayer extension pipe 142. The prototype pressure wand and scraping apparatus 100 couples a scraping blade 120 to a pressure sprayer extension pipe 142 via a pair of scraper to wand securing clamps 106. The scraping blade 120 is secured to a scraping apparatus spacer block 102. The scraping apparatus spacer block 102 provides a distance and desired angle between the pressure sprayer extension pipe 142 and scraping blade 120, resulting in a span between the discharged water spray and a blade edge 122 of the blade spatula section 124 of scraping blade 120. The scraping apparatus spacer block 102 has a main body including a sprayer pipe-receiving surface 112 along the top surface. The preferred pipe receiving surface 112 is in the shape of a "V" to provide the optimal shape for applying a clamping force onto the pressure sprayer extension pipe 142. This accommodates the range of diameters of the commercially offered pressure sprayer extension pipes 142. The scraper to wand securing clamps 106 are placed straddling the pressure sprayer extension pipe 142 with each side being positioned against a clamp clearance groove 114 of the scraping apparatus spacer block 102, then passing through either blade mounting apertures 126 or blade mounting notches 128 within the scraping blade 120. A female fastener 108 is then threaded to each end of the scraper to wand securing clamp 106 and subsequently tightened to apply a clamping force to the pressure sprayer extension pipe 142. The scraper to wand securing clamp 106, being a threaded rod, utilizes the threading to provide a textured surface disposed upon the receiving surface of the pressure sprayer extension pipe 142. The textured surface increases the friction between the scraper to wand securing clamp 106 and the pressure sprayer extension pipe 142, thus reducing any risk of slippage between the two components. The scraping apparatus spacer block 102 can additionally include at least one block aperture 116 to reduce the overall weight of the apparatus. The block aperture 116 can be designed in any shape, as long as the shape does not negatively impact the structural integrity of the overall apparatus.

Figure 9:
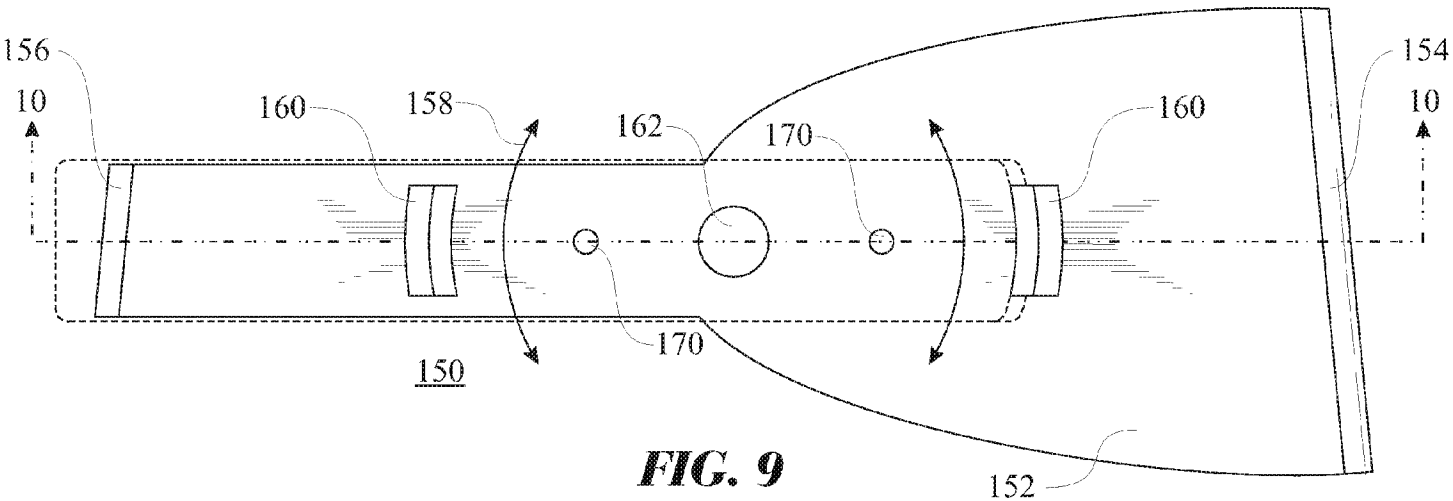
FIG. 9 is a top view of a rotating, dual-edged scraping blade.
Figure 10:
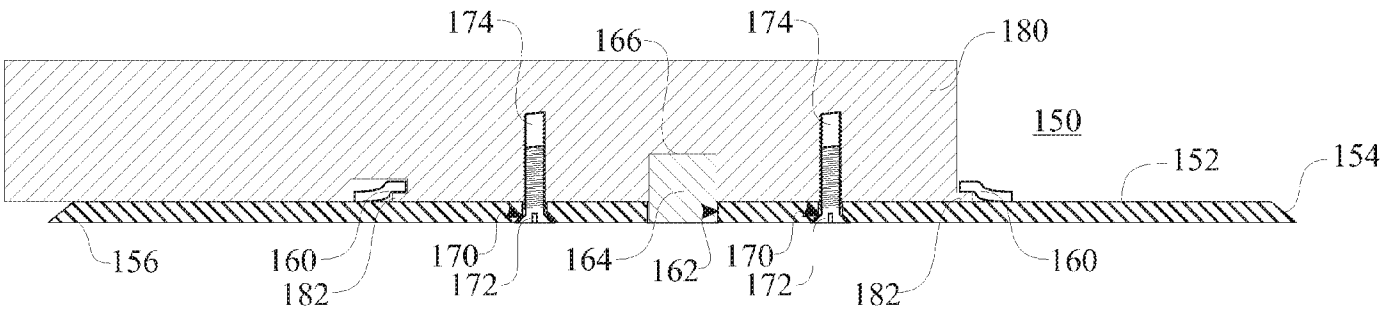
FIG. 10 is a sectional side view of the rotating, dual-edged scraping blade configuration taken along sectioning line 10-10 of FIG. 9.

The present invention can include a dual-edged blade 152, incorporated into a rotating dual-edged blade assembly 150 as presented in several exemplary embodiments illustrated in FIGS. 9 through 31. The dual-edged blade 152 comprises a first edge blade along a first edge of the blade 152 and a second edge blade located along a second edge of the blade 152, wherein the first edge and the second edge are on opposing ends of the blade 152. A first embodiment, as shown in FIGS. 9 and 10 assembles the dual-edged blade 152 to a pivot spacer block 180, wherein the dual-edged blade 152 pivots about a pivot axle 164, being secured into the desired orientation via a rotational locking design. The rotational locking design presented utilizes a pair of threaded securing members 172. The dual-edged blade 152 can have two different sized edges, such as a wide blade edge 154 and a narrow blade edge 156. It is desirable to be able to quickly convert from an edge of one width to an edge of a different width. Another desired feature is an assembly having a substantially flat or smooth bottom surface. The first embodiment illustrated accomplishes both features as follows: The pivot axle 164 is press fit into a block pivot sleeve 166 within the pivot spacer block 180 to a distance such that the pivot axle 164 does not project beyond the bottom of the double ended blade 152. The dual-edged blade 152 is assembled to the rotating double-ended blade assembly 150, placing the exposed portion of the pivot axle 164 through a blade pivot aperture 162 of the dual-edged blade 152. The dual-edged blade 152 is pivotally held against a bottom of the pivot spacer block 180 via at least one optional rotating blade guides 160 which interfaces with a respective spacer block pivot guides 182. It is recognized that many variations of the optional rotating blade guides 160 can be utilized and the shape presented is simply one example. A pair of threaded securing member 172 are inserted through a respective securing member aperture 170 of the dual-edged blade 152 and threaded into a block securing member sleeve 174 of the pivot spacer block 180. The user would unscrew the threaded securing member 172, rotate the dual-edged blade 152 via a pivoting motion 158, and re-secure the dual-edged blade 152 into the new position by re-inserting the threaded securing member 172.

Figure 11:
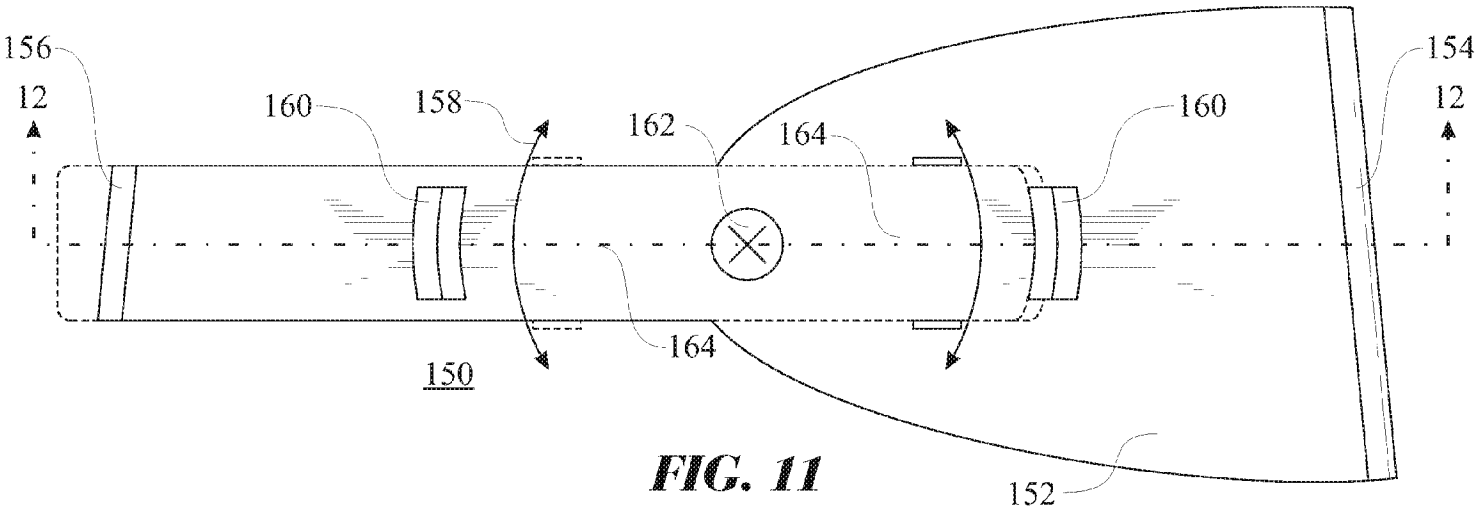
FIG. 11 is a top view of alternate embodiment of the rotating, dual-edged scraping blade of FIG. 9, presenting an anti-rotational swivel stop.
Figure 12:
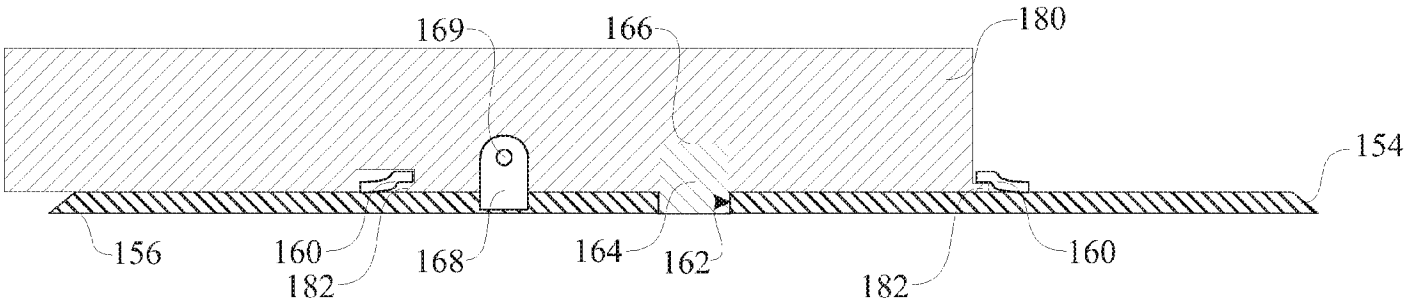
FIG. 12 is a sectional side view of the rotating, dual-edged scraping blade configuration taken along sectioning line—12-12 of FIG. 11.
Figure 13:
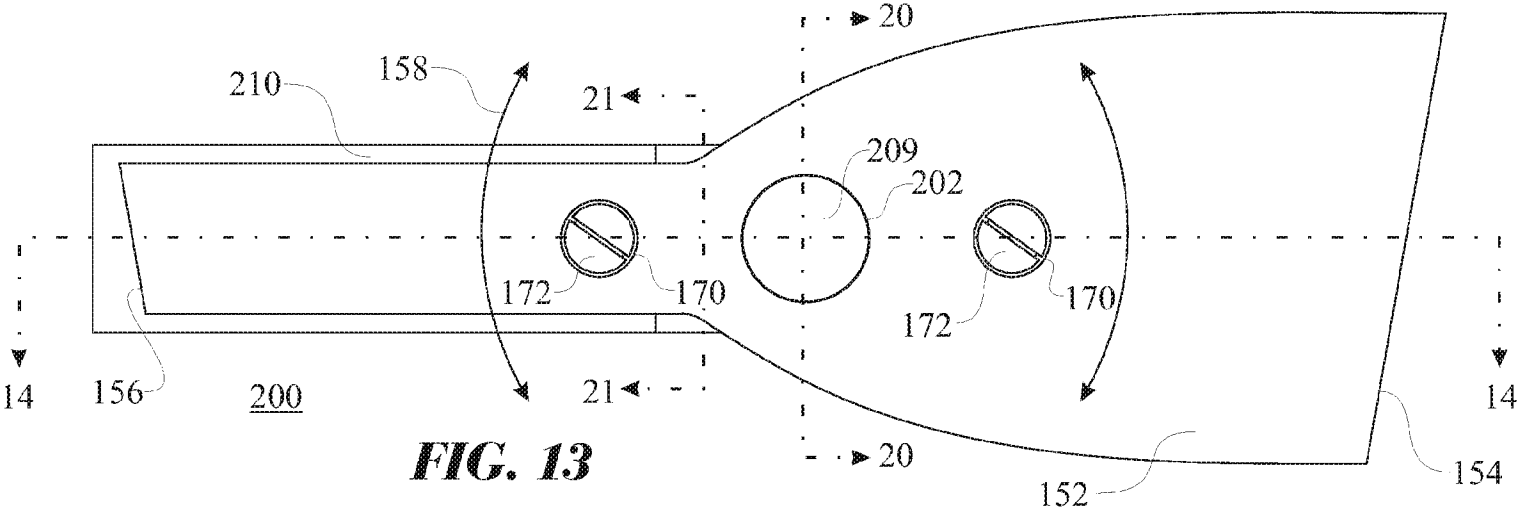
FIG. 13 is a bottom view of an alternate embodiment of the rotating, dual-edged scraping blade.
Figure 14:
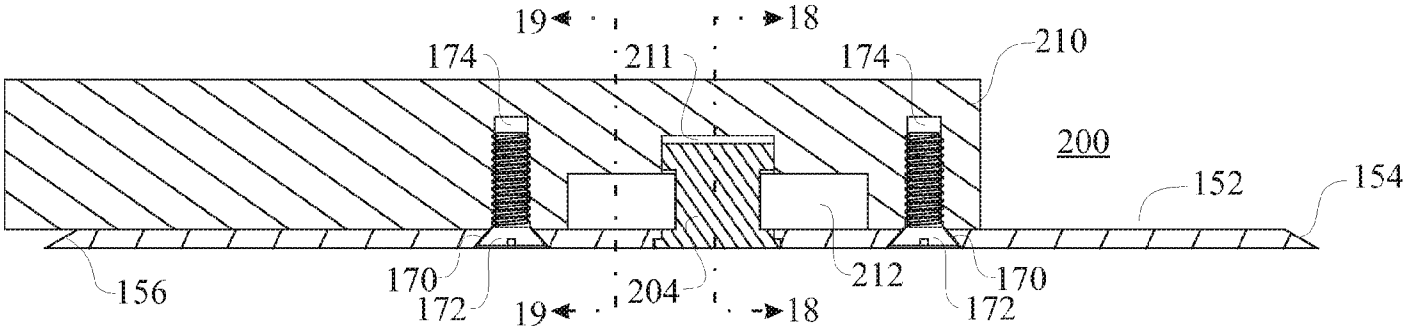
FIG. 14 is a sectional side view of the rotating, dual-edged scraping blade configuration taken along sectioning line—14-14 of FIG. 13.
Figure 15:
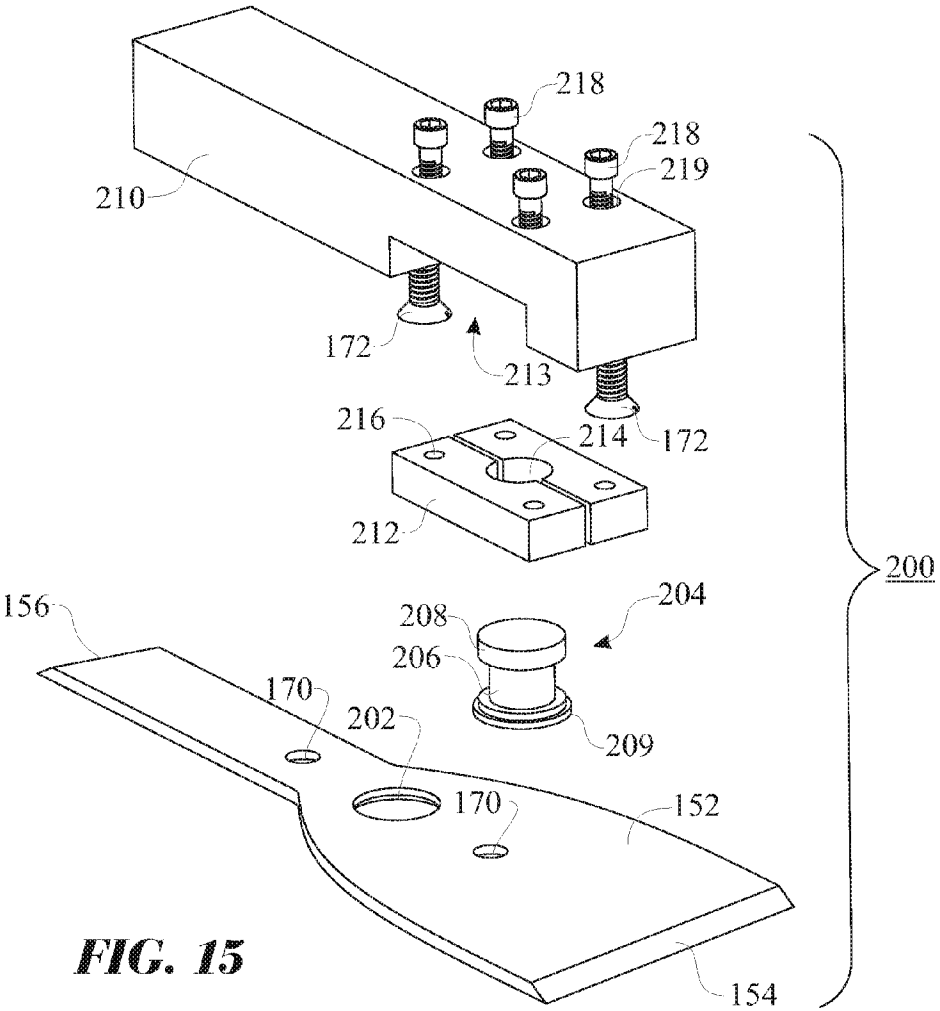
FIG. 15 is an isometric, exploded assembly view of the rotating, dual-edged scraping blade configuration of FIG. 13.
Figure 16:
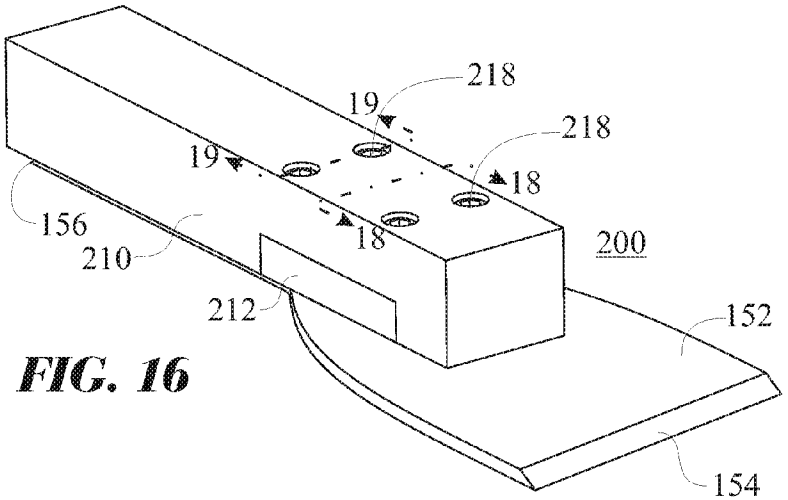
FIG. 16 is an isometric, top view of the rotating, dual-edged scraping blade configuration of FIG. 13.
Figure 17:
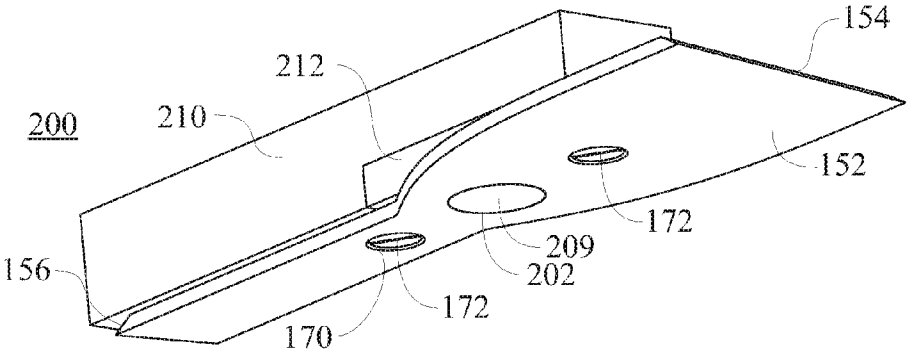
FIG. 17 is an isometric, bottom view of the rotating, dual-edged scraping blade configuration of FIG. 13.
Figure 18:
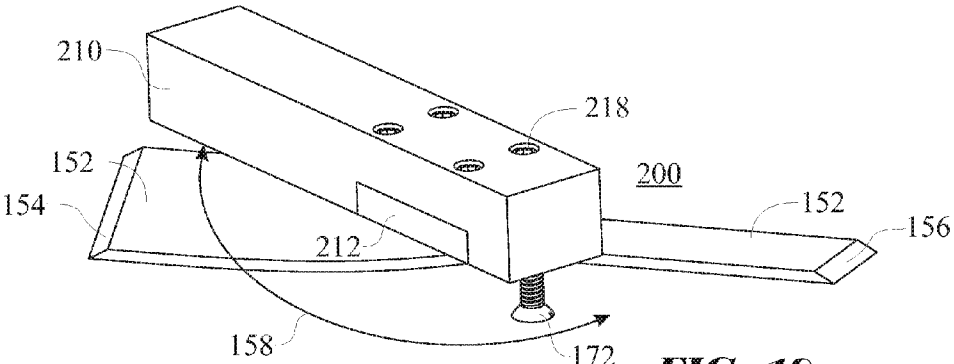
FIG. 18 is an isometric, top view of the rotating, dual-edged scraping blade configuration of FIG. 13, further illustrating a rotating motion of the dual-edged blade.
Figure 19:
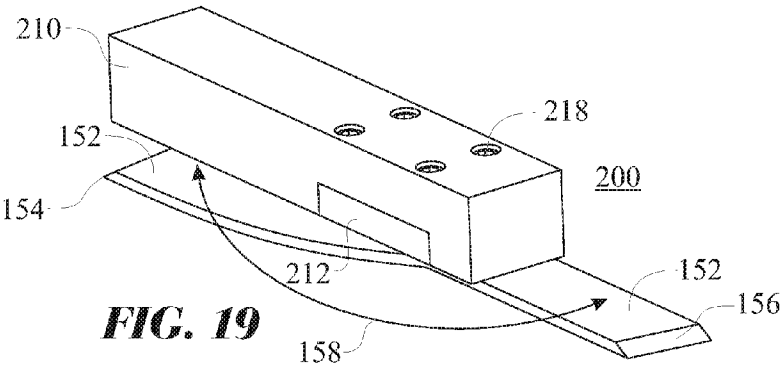
FIG. 19 is an isometric, top view of the rotating, dual-edged scraping blade configuration of FIG. 13, further illustrating the dual-edged, scraping blade in a fully rotated orientation.
Figure 21:
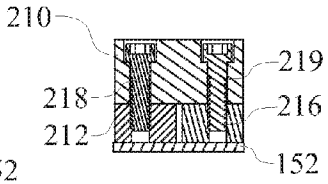
FIG. 21 is a sectional view through a pair of pivot axle mounting screws for the rotating, dual-edged scraping blade configuration taken along sectioning line 21-21 of FIG. 13.
Figure 20:
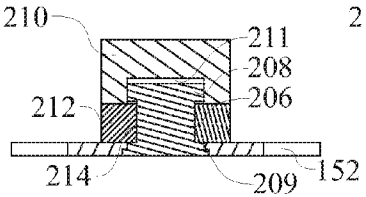
FIG. 20 is sectional view through a pivot axle for the rotating, dual-edged scraping blade configuration taken along sectioning line 20-20 of FIG. 13.
Figure 22:
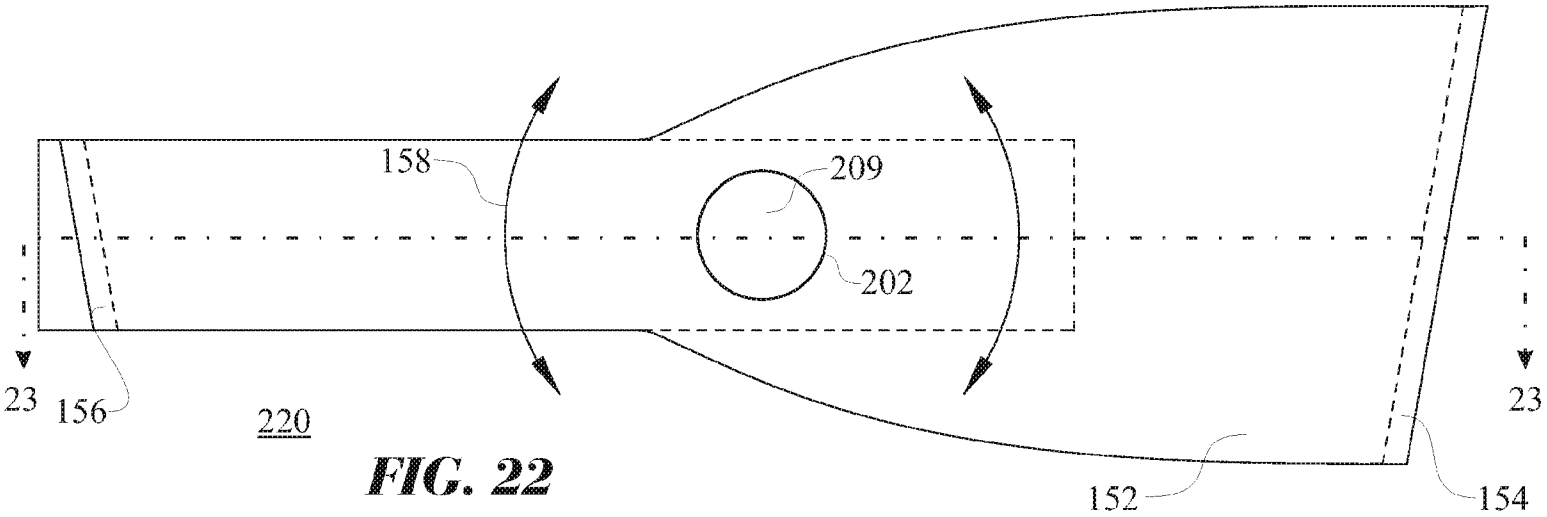
FIG. 22 is a bottom view of another alternate embodiment of the rotating, dual-edged scraping blade assembly.
Figure 23:
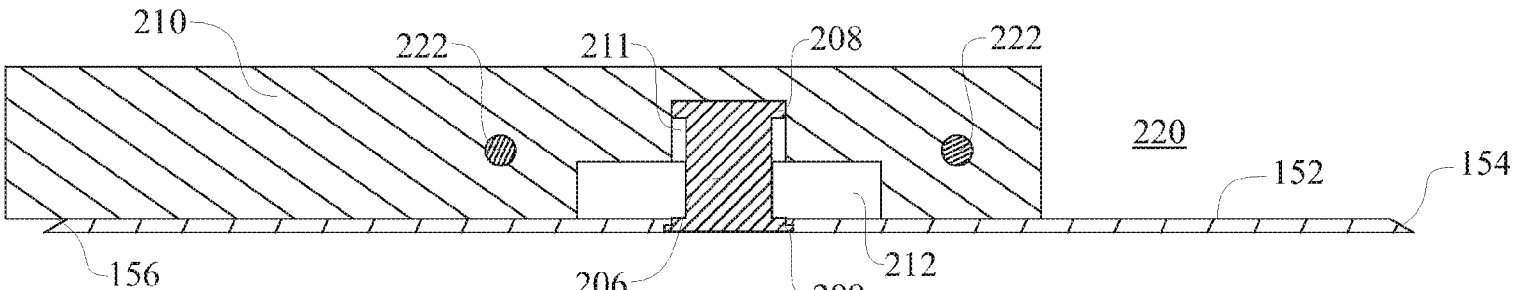
FIG. 23 is a sectional side view of the rotating, dual-edged scraping blade configuration taken along sectioning line 23-23 of FIG. 22.
Figure 24:
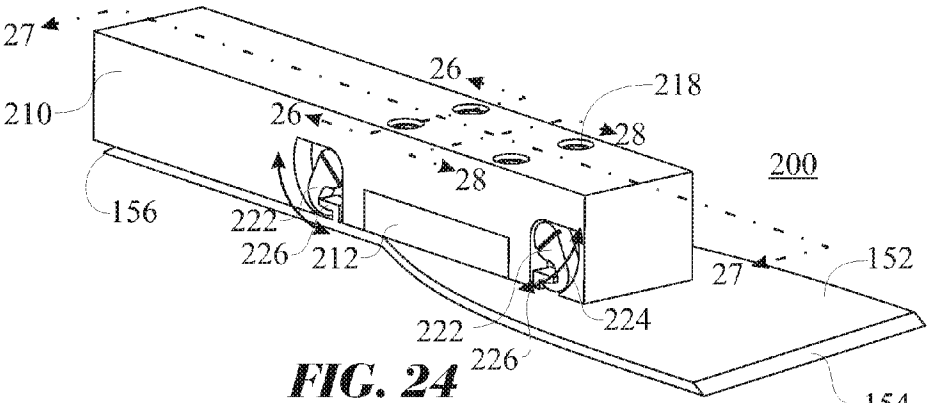
FIG. 24 is an isometric, top view of yet another rotating, dual-edged scraping blade configuration utilizing locking cams.
Figure 25:
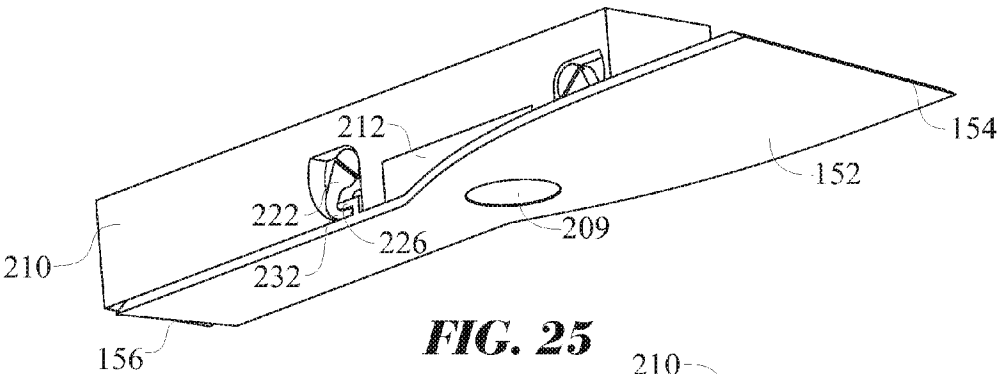
FIG. 25 is an isometric, bottom view of the rotating, dual-edged scraping blade configuration of FIG. 24.
Figure 26:
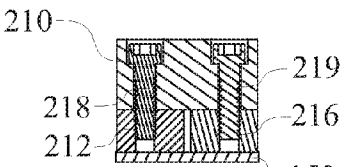
FIG. 26 is a sectional side view of the rotating, dual-edged scraping blade configuration taken along sectioning line 26-26 of FIG. 24.
Figure 27:
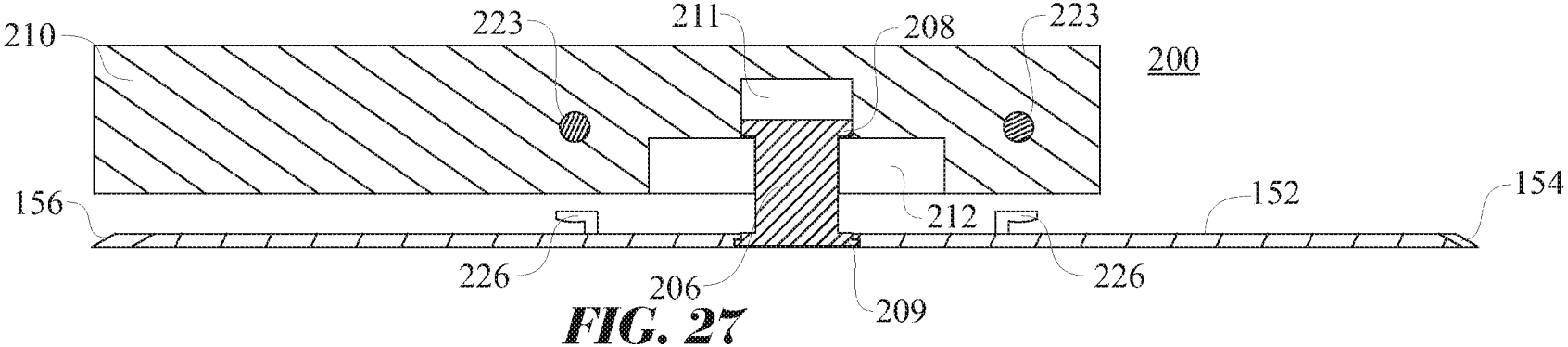
FIG. 27 is a sectional side view of the rotating, dual-edged scraping blade configuration taken along sectioning line 27-27 of FIG. 24.
Figure 29:
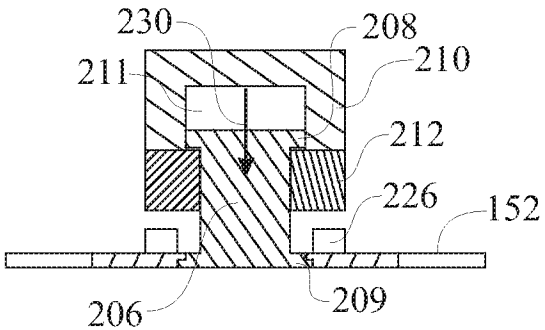
FIG. 29 is a sectional side view of the rotating, dual-edged scraping blade configuration taken along sectioning line 28-28 of FIG. 24, presenting the blade position when the cams are in a released state.
Figure 28:
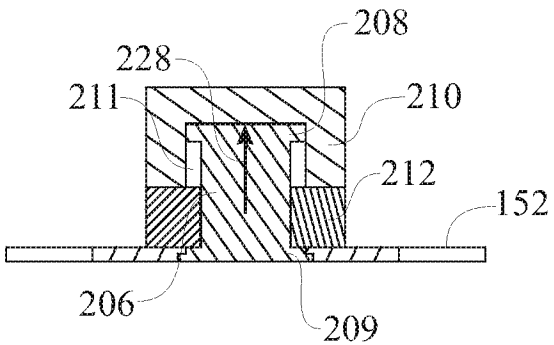
FIG. 28 is a sectional side view of the rotating, dual-edged scraping blade configuration taken along sectioning line 28-28 of FIG. 24, presenting the blade position when the cams are in a locked state.
Figure 30:
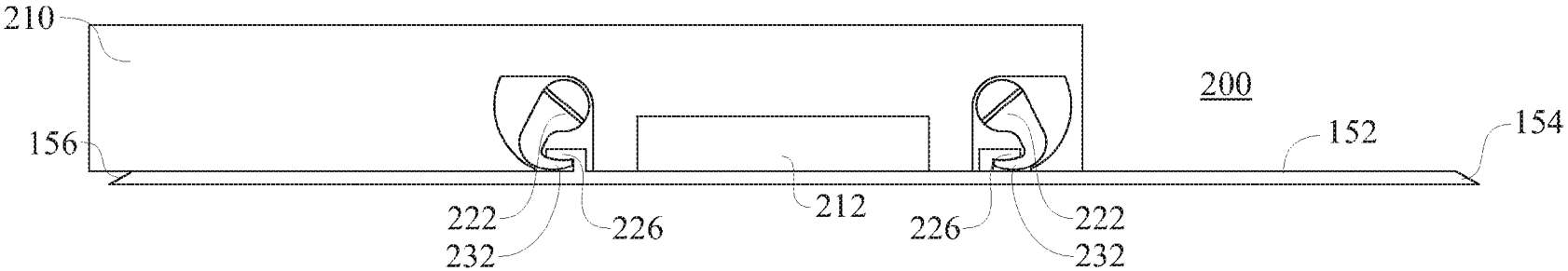
FIG. 30 is a side view of the rotating, dual-edged scraping blade configuration of FIG. 24.
Figure 31:
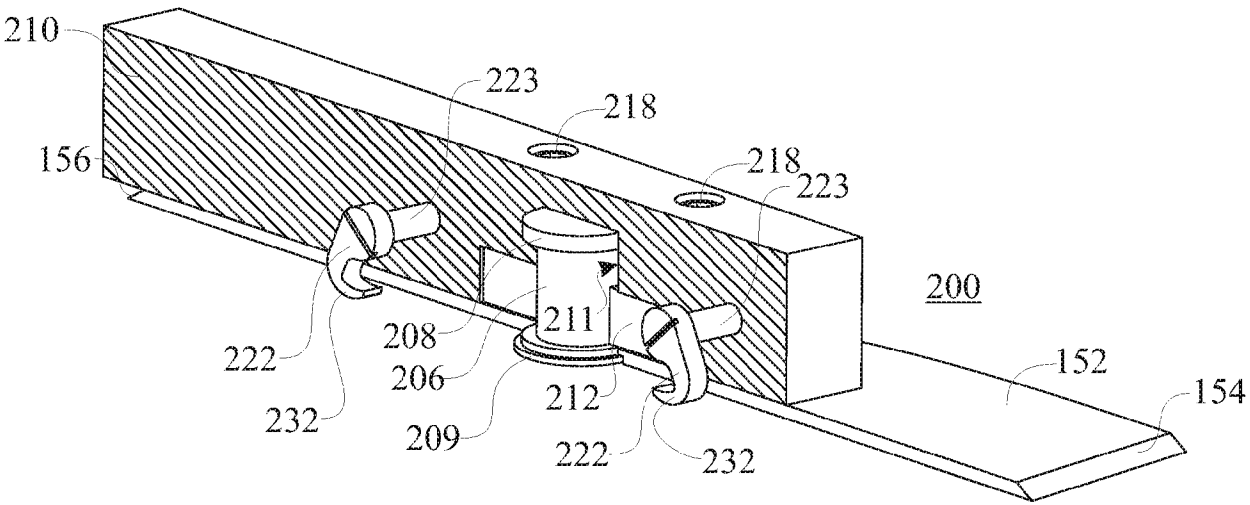
FIG. 31 is an isometric, sectional view of the rotating, dual-edged scraping blade configuration of FIG. 24 taken along sectioning line 27-27 illustrating the complete elements of the cams and pivot axle.

An alternate position securing design is illustrated in FIGS. 11 and 12. A plurality of rotating blade stop 168 is pivotally assembled to the pivot spacer block 180 via a rotating blade stop fastener 169. The rotating blade stop 168 would be rotated upward about the rotating blade stop fastener 169, providing clearance for the dual-edged blade 152 to pivot in accordance with a pivoting motion 158.

Yet, another embodiment is presented in FIGS. 13 through 21. A rotating dual-edged blade assembly 200 incorporates the same rotational locking design, while replacing the pivot axle 164 utilizing a dual function pivot axle design. The illustrated dual function pivot axle design of the rotating dual-edged blade assembly 200 utilizes a pivot axle spool 204, the pivot axle spool 204 having a spool axle section 206, spool block securing flange 208, and a spool blade securing flange 209. The spool blade-securing flange 209 is a countersunk style flange. The spool block securing flange 208 has a diameter that is equal to or smaller than a diameter of a countersunk pivot aperture 202, allowing the spool block securing flange 208 to be inserted through the countersunk pivot aperture 202 of the dual-edged blade 152. The countersunk pivot aperture 202 incorporates a countersunk edge for receiving the spool blade-securing flange 209. The pivot axle spool 204 is secured to a pivot spacer block 210 by placing a pivot axle-receiving collar 214 formed via a pair of pivot collar members 212 about the spool axle section 206. The pivot collar members 212 are then assembled to a collar receiving section 213 of the pivot spacer block 210 using a plurality of collar to block fasteners 218. The collar to block fasteners 218 are inserted through respective collar fastener apertures 219 of the pivot spacer block 210, then threaded into respective threaded securing members 216 of the pivot collar members 212. The spool block securing flange 208 is inserted into a block flange clearance 211 formed within the pivot spacer block 210. The user would unscrew the threaded securing members 172, rotate the dual-edged blade 152 via the pivoting motion 158, and re-secure the dual-edged blade 152 into the new position by re-inserting the threaded securing members 172. The dual-edged blade 152 is held against a bottom of the pivot spacer block 210 by the countersunk flange design of the spool blade-securing flange 209.

Yet, another embodiment is presented in FIGS. 22 through 31. A cam locking rotating blade assembly 220 incorporates a similar dual function pivot axle design as previously presented, utilizing a rotational locking design having cams 222 instead of locking screws 172. The dual-edged blade 152 incorporates a plurality of cam interfacing blade clips 226. The spool axle section 206 can be of a length and the block flange clearance 211 can have a depth allowing for a distance to be provided between a top of the dual-edged blade 152 and a bottom of the pivot spacer block 210 when the cams 222 are released. A plurality of cams 222 is pivotally assembled to the pivot spacer block 210 via a cam shaft 223. The user rotates the dual-edged blade 152 into the desired orientation via the pivoting motion 158. The user then rotates each of the cams 222 via a cam rotation 224, thus engaging the cam latching finger 232 with the blade clips 226 resulting in a upward locking motion 228. To rotate the dual-edged blade 152, the user releases the cams 222, disengaging the cam-latching finger 232 from the blade clips 226, resulting in a downward releasing motion 230. The blade clips 226 are lowered below the bottom of the pivot spacer block 210.

Figure 32:
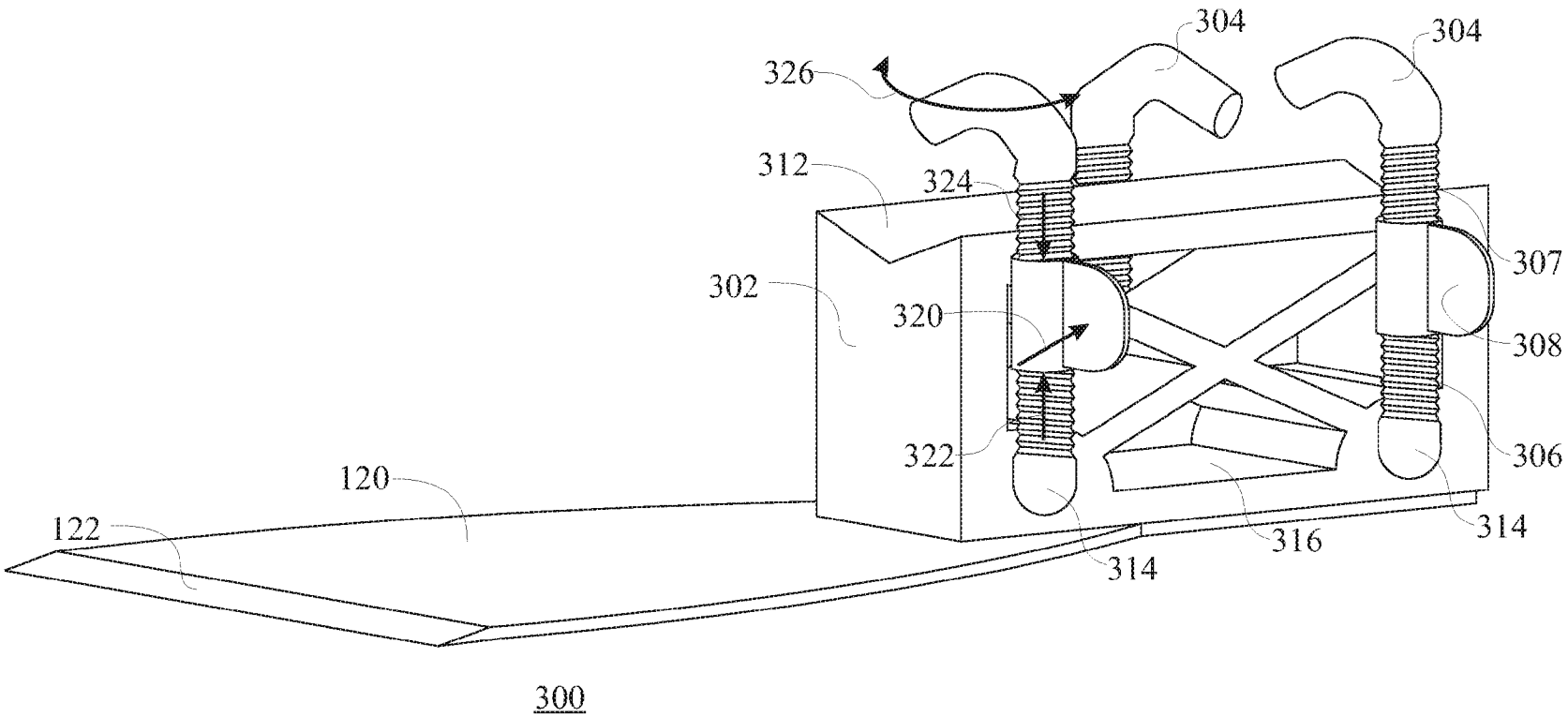
FIG. 32 presents an isometric view of a scraping blade assembly comprising a quick release wand coupling mechanism.
Figure 33:
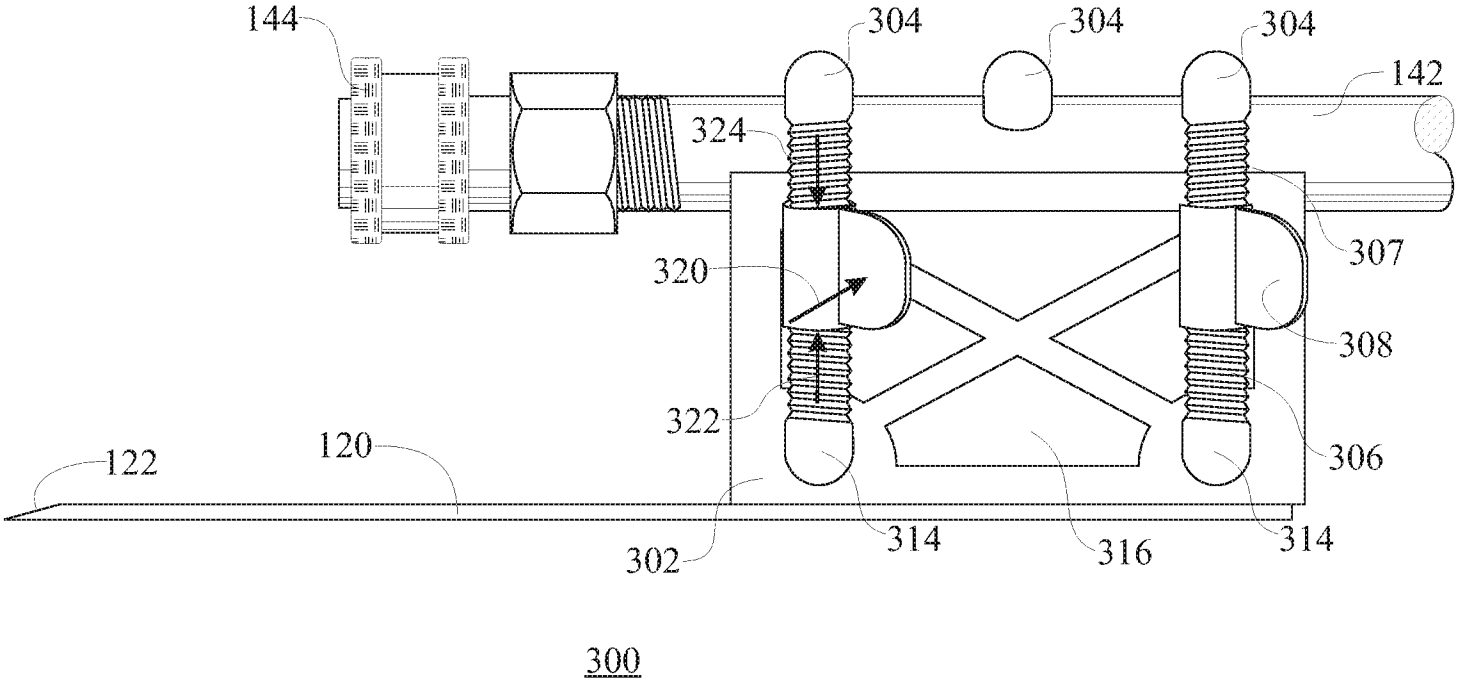
FIG. 33 presents a side view of the scraping blade assembly of FIG. 32.
Figure 34:
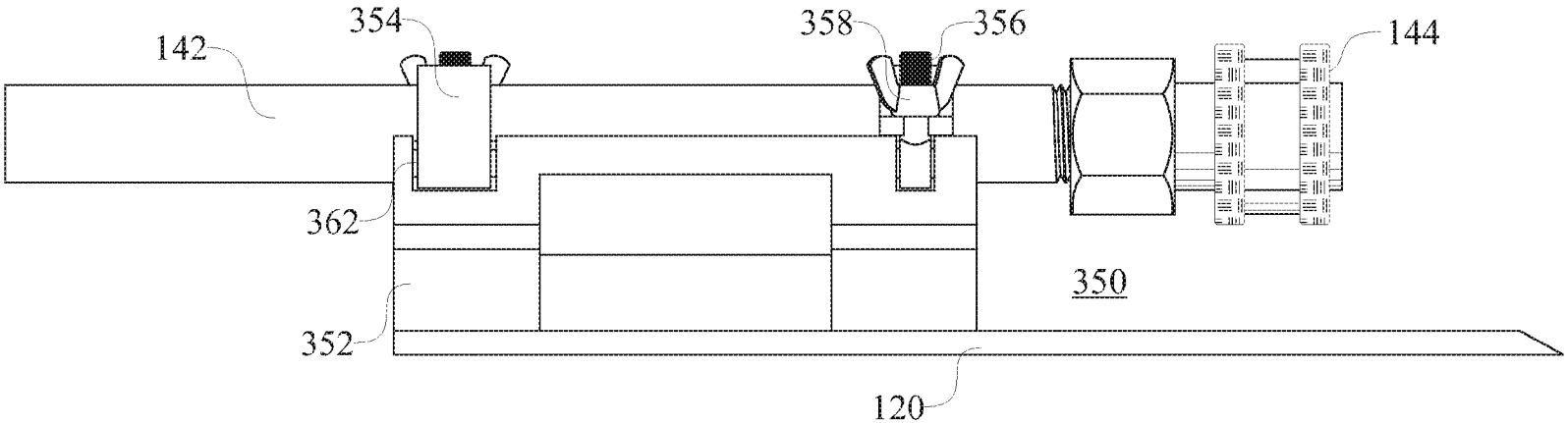
FIG. 34 is a side view of an scraping blade assembly comprising an alternate quick release wand coupling mechanism.
Figure 35:
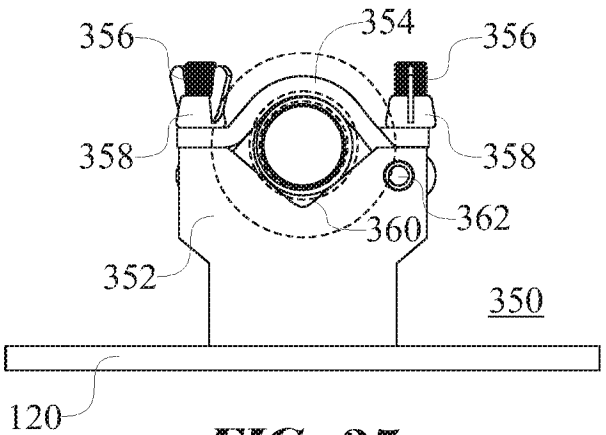
FIG. 35 presents a front view of the scraping blade assembly of FIG. 34.
Figure 36:
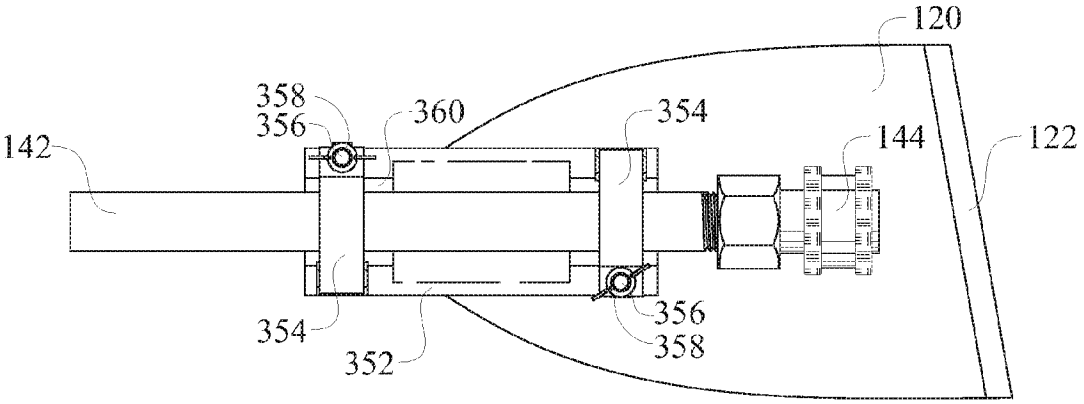
FIG. 36 presents a top view of the scraping blade assembly of FIG. 34.
Figure 37:
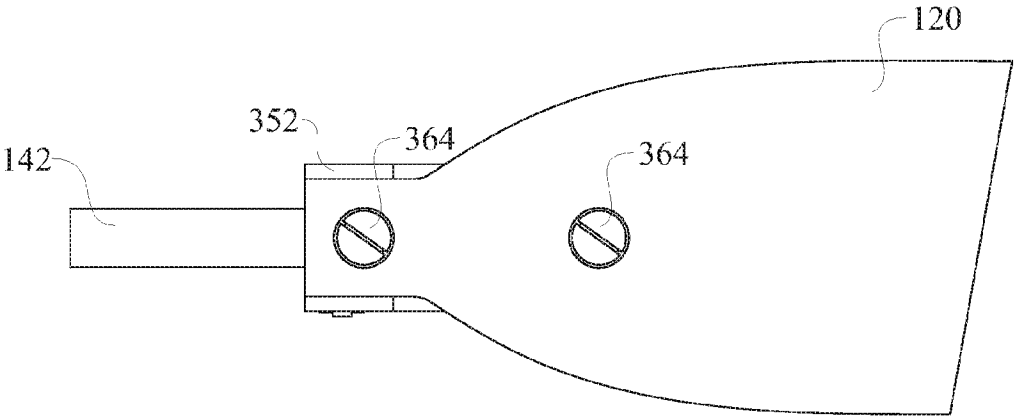
FIG. 37 presents a bottom view of the scraping blade assembly of FIG. 34.
Figure 38:
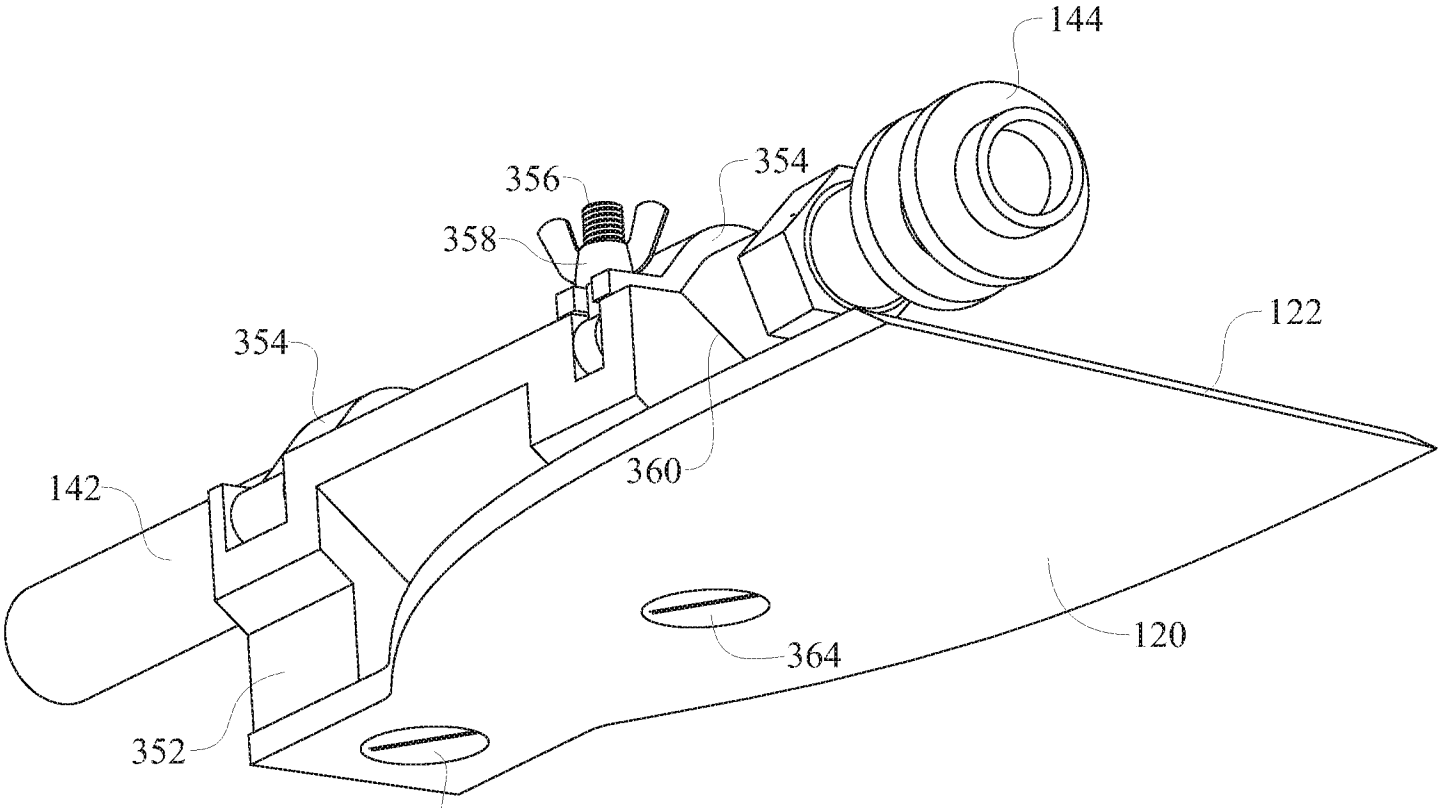
FIG. 38 presents an isometric, bottom view of the scraping blade assembly of FIG. 34.
Figure 39:
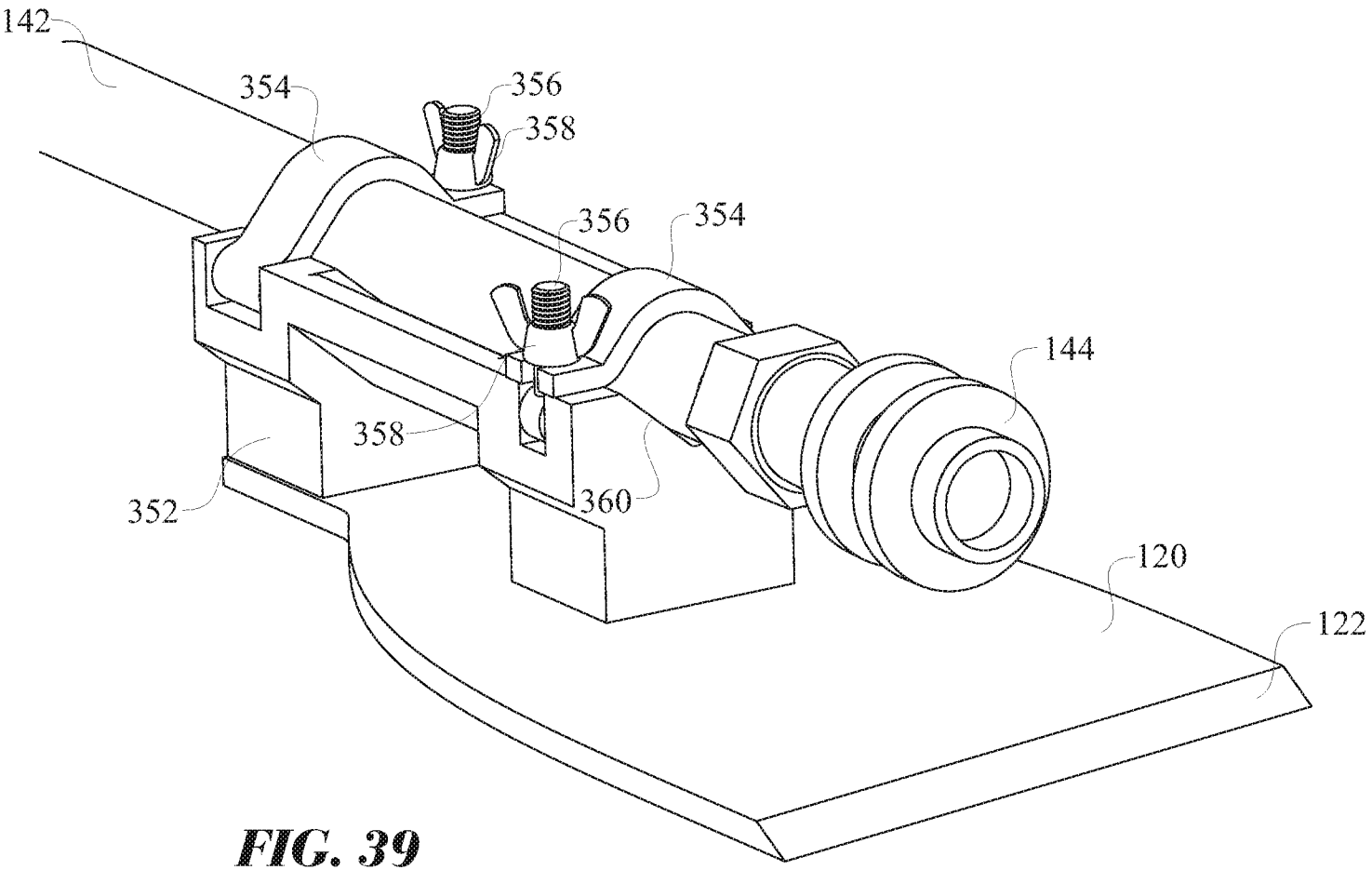
FIG. 39 presents an isometric, top view of the scraping blade assembly of FIG. 34 presenting the blade assembly being secured to the pressure cleaning wand.
Figure 41:
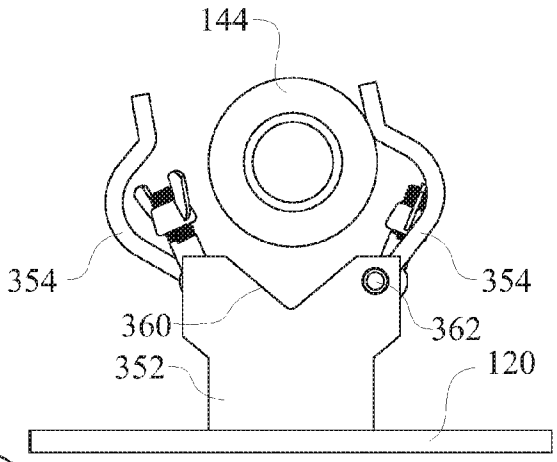
FIG. 41 presents a front view of the scraping blade assembly of FIG. 34 presenting the blade assembly being released from the pressure-cleaning wand.
Figure 40:
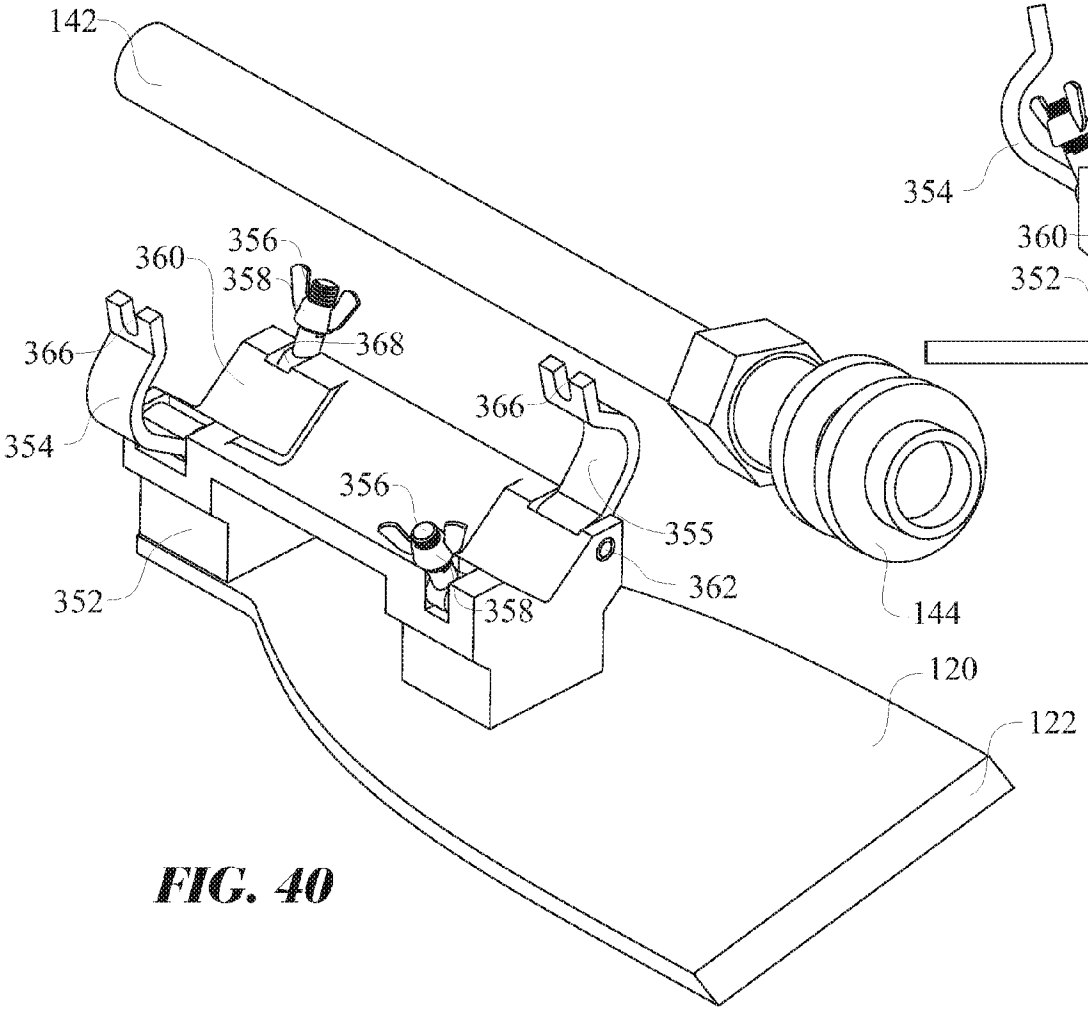
FIG. 40 presents an isometric, top view of the scraping blade assembly of FIG. 34 presenting the blade assembly being released from the pressure cleaning wand.

The present invention is furthered with the inclusion of a quick disconnect wand coupling assembly. Two exemplary embodiments are presented in the drawings. A quick release scraping apparatus 300 is presented in FIGS. 32 and 33. The quick release scraping apparatus 300 comprising the scraping blade 120 or a dual-edged blade 152 (presented earlier) assembled to a scraper spacing block 302 in accordance with the blade to body assembly configurations previously presented. The pressure sprayer extension pipe 142 is secured to the scraper spacing block 302 by placing the pressure sprayer extension pipe 142 against a sprayer pipe receiving surface 312, rotating each wand clamping hook 304 such to straddle the top of the pressure sprayer extension pipe 142, then applying a securing motion 320 to a mixed-thread locking cam 308.

The mixed-thread locking cam 308 is assembled between a reverse threaded rod 306 and a standard threaded rod 307. The reverse threaded rod 306 is a threaded rod having standard oriented threads. The standard threaded rod 307 is a threaded rod having reverse oriented threads. The mixed thread-locking cam 308 is a threaded fastener having both standard oriented threads at a first end and reverse oriented threads at the opposing end. The threaded clamping assembly is assembled to the scraper spacing block 302 via a clamp anchor 314. When the mixed thread-locking cam 308 is rotated in accordance with the securing motion 320, the motion applies a reverse thread clamping force 322 and a standard thread clamping force 324. The clamping tension can be adjusted by rotating the various threaded components 306, 307 prior to positioning the pressure sprayer extension pipe 142. It is desirable to include a textured surface on the contacting area of the wand-clamping hook 304. At least one block aperture 316 of any shape as previously presented can be incorporated into the scraper spacing block 302 to reduce weight.

A quick release scraping apparatus 350 is presented in FIGS. 34 through 41. The quick release scraping apparatus 350 comprising the scraping blade 120 or a dual-edged blade 152 (presented earlier) assembled to a scraper spacing block 352 in accordance with the blade to body assembly configurations previously presented. The pressure sprayer extension pipe 142 is positioned onto a sprayer pipe receiving surface 360 of the scraper spacing block 352. A plurality of clamping arms 354 is pivotally assembled to the scraper spacing block 352 via a clamping arm hinge pin 362. A threaded locking member 356 is assembled to the scraper spacing block 352 via a locking member hinge 368 as a means for securing the clamping arm 354 about the pressure sprayer extension pipe 142. The clamping arm 354 is rotated over the pressure sprayer extension pipe 142 and the threaded locking member 356 is rotated into a clamping arm latching fork 366 of the clamping arm 354. A wing nut fastener 358 is threaded onto the threaded locking member 356 and subsequently tightened, thus applying a clamping force onto the pressure sprayer extension pipe 142. A arm clamping surface 355 can have a textured surface, ridges, a secondary material, and the like to increase the friction between the arm clamping surface 355 and the pressure sprayer extension pipe 142. The orientation of the clamping arms and fasteners can be either opposite as illustrated or parallel, placing the threaded locking member 356 proximate the same edge of the scraper spacing block 352. The embodiment illustrated presents a scraper spacing block 352 having two legs and an open section. It is understood the shape of the scraper spacing block 352 other than the specific features presented can be of a designers choice.

What is claimed is:

1. A scraping apparatus assembly for use with a pressure cleaning wand having a nozzle for emitting a fluid to remove debris from a planar work surface, the scraping apparatus assembly comprising:

a scraping blade is fabricated of a planar material having at least one blade edge provided along a distal end thereof and a planar mounting section located proximate an opposite proximal end thereof;

a scraping apparatus spacer block having a wand-engaging surface provided along one surface of the scraping apparatus spacer block and a planar blade-engaging receiving surface provided on a side opposite the wand-engaging surface, wherein the scraping apparatus spacer block provides a distance between the wand-engaging surface and the blade receiving surface for maintaining the wand and the scraping blade in spaced-apart relationship to one another;

wherein the scraping blade planar-mounting section is assembled to the planar blade-engaging receiving surface orienting, thereby the scraping blade distal end blade edge opposite the planar mounting section, in a manner extending said blade edge beyond and forward of the scraping apparatus space block such that, during use, a bottom surface of the scraping blade distal end is unencumbered by any structure between said bottom surface and said work surface; and at least one nozzle securing clamp providing a clamping force between a surface of the respective nozzle securing clamp and the pipe engaging surface of the spacer block;

wherein, during use, the spacer block maintains the planar blade between the wand nozzle and the planar work surface.

2. A scraping apparatus assembly for use with a pressure cleaning wand having a nozzle for emitting a fluid to remove debris from a planar work surface as recited in claim 1, wherein a bottom of the scraping apparatus assembly is planar with a bottom surface of the scraping blade.

3. A scraping apparatus assembly for use with a pressure cleaning wand having a nozzle for emitting a fluid to remove debris from a planar work surface as recited in claim 1, wherein a pressure washer nozzle area engaging surface of at least one of the following is textured to increase a frictional interface between mating components:

a wand engaging surface of the nozzle securing clamp and the wand engaging surface of the scraping apparatus spacer block.

4. A scraping apparatus assembly for use with a pressure cleaning wand having a nozzle for emitting a fluid to remove debris from a planar work surface as recited in claim 1, wherein the at least one nozzle securing clamp pivots providing a quick disconnect clamp removal.

5. A scraping apparatus assembly for use with a pressure cleaning wand having a nozzle for emitting a fluid to remove debris from a planar work surface as recited in claim 1, wherein the scraping apparatus assembly further comprises a double-ended blade.

6. A scraping apparatus assembly for use with a pressure cleaning wand having a nozzle for emitting a fluid to remove debris from a planar work surface as recited in claim 5, the double-ended blade further comprising a first blade edge and a second blade edge, wherein the double-ended blade is pivotally assembled proximate a bottom of the scraping apparatus spacer block.

7. A scraping apparatus assembly for use with a pressure cleaning wand having a nozzle for emitting a fluid to remove debris from a planar work surface as recited in claim 6, wherein the double-ended blade is releasably secured into the desired orientation.

8. A scraping apparatus assembly for use with a pressure cleaning assembly comprising a pressure cleaning wand and a nozzle for emitting a fluid to remove debris from a planar work surface, the scraping apparatus assembly comprising:

a scraping blade fabricated of a planar material having a blade edge formed along one end thereof and a planar mounting section located proximate an opposite end thereof; and a scraping apparatus spacer block having a pipe connection section provided along an upper portion of the scraping apparatus spacer block and a planar blade-engaging receiving surface provided on a lower portion of the scraping apparatus spacer block, wherein the scraping apparatus spacer block provides a spatial arrangement between the pipe connection section and the planar blade receiving surface for maintaining the wand and the scraping blade in spaced-apart relationship to one another;

wherein the scraping blade planar-mounting section is assembled to the planar blade-engaging receiving surface orienting the blade edge opposite the planar mounting section extending forward from the scraping apparatus space block such that, during use, a bottom surface of a scraping blade distal end is unencumbered by any structure between said bottom surface and said work surface;

wherein the pipe connection section is configured to connected with the pressure cleaning assembly;

wherein, during use, the spacer block maintains the planar blade between the wand nozzle and the planar work surface and wherein the scraping blade further comprises a first blade edge and a second blade edge, wherein the second blade edge is formed at an end opposite the first blade edge.

9. A scraping apparatus assembly for use with a pressure cleaning assembly comprising a pressure cleaning wand and a nozzle for emitting a fluid to remove debris from a planar work surface as recited in claim 8, wherein the scraping blade further comprises a reversible mounting enabling the scraping blade to rotate between a first configuration positioning one of the first blade edge and a first configuration positioning the second blade edge forward of the pressure washing nozzle assembly.

10. A scraping apparatus assembly for use with a pressure cleaning assembly comprising a pressure cleaning wand and a nozzle for emitting a fluid to remove debris from a planar work surface as recited in claim 9, wherein the scraping blade is releasably secured into the desired orientation using at least one threaded blade fastener.

11. A scraping apparatus assembly for use with a pressure cleaning assembly comprising a pressure cleaning wand and a nozzle for emitting a fluid to remove debris from a planar work surface, the scraping apparatus assembly comprising:

a scraping blade fabricated of a planar material having a blade edge formed along one end thereof and a planar mounting section located proximate an opposite end thereof;

a scraping apparatus spacer block having a pipe connection section provided along an upper portion of the scraping apparatus spacer block and a planar blade-engaging receiving surface provided on a lower portion of the scraping apparatus spacer block, wherein the scraping apparatus spacer block provides a spatial arrangement between the pipe connection section and the blade receiving surface for maintaining the wand and the scraping blade in spaced-apart relationship to one another, the pipe connection section comprising a tubular shape;

wherein the scraping blade planar-mounting section is assembled to the planar blade-engaging receiving surface orienting the blade edge opposite the planar mounting section extending forward from a scraping apparatus space block such that, during use, a bottom surface of the scraping blade distal end is unencumbered by any structure between said bottom surface and said work surface; and a pressure cleaning nozzle assembly, the pressure cleaning nozzle assembly comprising a spray nozzle located at a distal end of an extension pipe, wherein the extension pipe and the pipe connection section are removably assembled together;

wherein, during use, the spacer block maintains the planar blade between the wand nozzle and the planar work surface wherein the planar material further comprises a first blade edge, and a second blade edge, the second blade edge is formed at an end opposite the first blade edge.

12. A scraping apparatus assembly for use with a pressure cleaning assembly comprising a pressure cleaning wand and a nozzle for emitting a fluid to remove debris from a planar work surface as recited in claim 11, wherein the first blade edge has a first width and the second blade edge has a second width;

wherein the first width is narrower than the second width.

13. A scraping apparatus assembly for use with a pressure cleaning assembly comprising a pressure cleaning wand and a nozzle for emitting a fluid to remove debris from a planar work surface as recited in claim 11, wherein the scraping blade further comprises a reversible mounting enabling the scraping blade to rotate between a first configuration positioning one of the first blade edge and a first configuration positioning the second blade edge forward of the pressure washing nozzle assembly.

14. A scraping apparatus assembly for use with a pressure cleaning assembly comprising a pressure cleaning wand and a nozzle for emitting a fluid to remove debris from a planar work surface as recited in claim 13, wherein the scraping blade is releasably secured into the desired orientation using at least one threaded blade fastener.

* * * * *